US008855527B2

(12) United States Patent
Pingel et al.

(10) Patent No.: US 8,855,527 B2
(45) Date of Patent: Oct. 7, 2014

(54) SEALING DEVICE INCLUDING A FIRST REPLACEABLE COMPLIANT SEALING MEMBER AND A LATCH MEMBER

(75) Inventors: James Pingel, San Diego, CA (US); David Sabo, San Diego, CA (US); Christopher S Tanner, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 167 days.

(21) Appl. No.: 13/560,481

(22) Filed: Jul. 27, 2012

(65) Prior Publication Data

US 2014/0029971 A1 Jan. 30, 2014

(51) Int. Cl.
*G03G 15/08* (2006.01)

(52) U.S. Cl.
USPC ..... 399/103

(58) Field of Classification Search
USPC ..... 399/91, 98, 99, 102, 103, 107, 110, 399/111, 119, 120
See application file for complete search history.

(56) References Cited

U.S. PATENT DOCUMENTS

| | | | | |
|---|---|---|---|---|
| 5,650,841 | A * | 7/1997 | Matsuda et al. | 399/111 |
| 5,926,672 | A * | 7/1999 | Nishibata et al. | 399/111 |
| 5,943,528 | A * | 8/1999 | Akutsu et al. | 399/110 |
| 5,987,277 | A | 11/1999 | Okabe | |
| 7,177,565 | B1 | 2/2007 | Miller | |
| 7,627,265 | B2 | 12/2009 | Gayne et al. | |
| 2005/0152714 | A1 | 7/2005 | Lansdown | |

FOREIGN PATENT DOCUMENTS

| | | |
|---|---|---|
| CN | 201319117 Y | 9/2009 |
| KR | 100287139 B1 | 1/2001 |

* cited by examiner

*Primary Examiner* — Hoan Tran

(57) ABSTRACT

A sealing device usable with an ink developer unit including a plurality of rollers and a plurality of end cap members includes a first replaceable compliant sealing member and a latch member. The first replaceable compliant sealing member has a plurality of replaceable seal exterior surfaces to form a seal between a first set of rollers of the plurality of rollers and one of the end cap members. The latch member has a closed state to maintain a sealing force on the first replaceable compliant sealing member and an open state to remove the sealing force on the first replaceable complaint sealing member.

18 Claims, 8 Drawing Sheets

SEALING DEVICE INCLUDING A FIRST REPLACEABLE COMPLIANT SEALING MEMBER AND A LATCH MEMBER

BACKGROUND

Ink developer units are used in image forming apparatuses to supply ink to a photoconductive drum to form images on substrates. Ink developer units include sealing devices to prevent ink from leaking out of the ink developer units.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
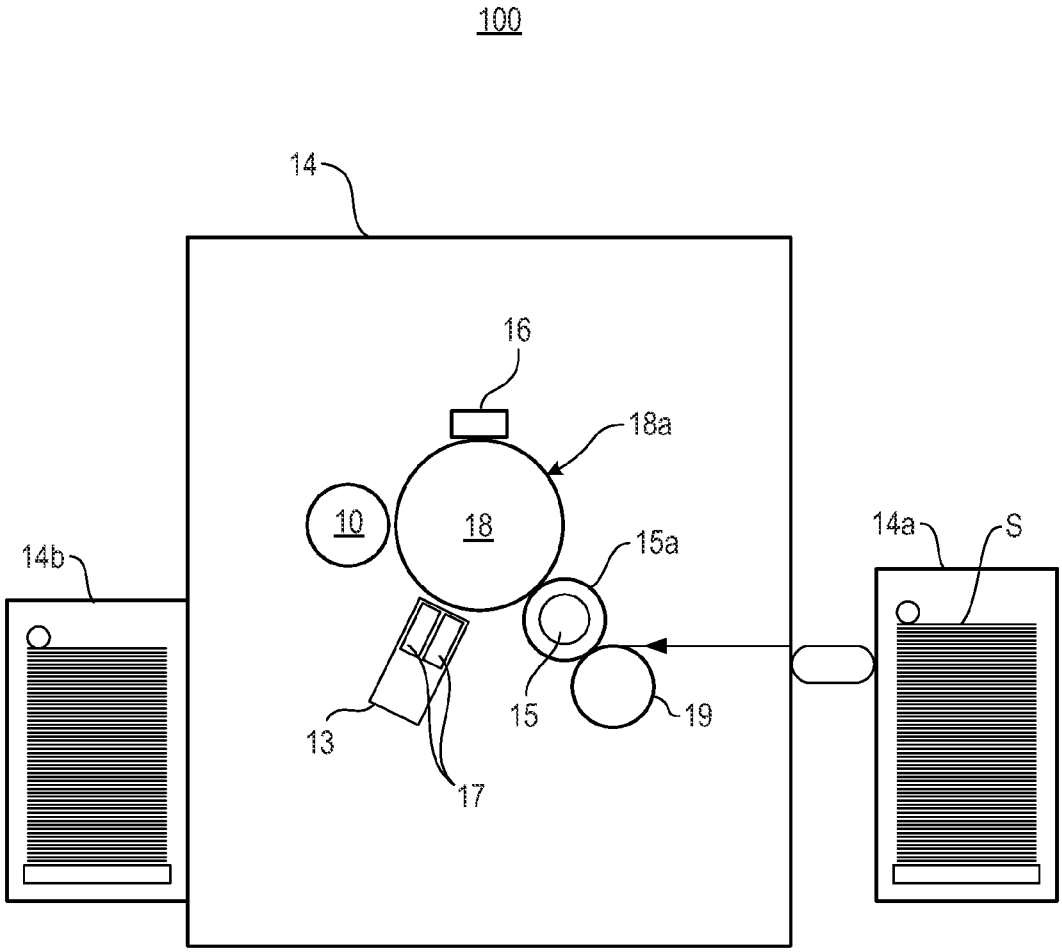
FIG. 1 is a schematic view illustrating an image forming apparatus having an ink developer unit including a sealing device according to an example.

In the following detailed description, reference is made to the accompanying drawings which form a part hereof, and in which is detected by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Sealing devices may be used in ink developer units. Ink developer units such as binary ink developers (BIDS) may be used in image forming apparatuses such as liquid electrophotography printers (LEP) and include rollers to supply ink to a photoconductive drum to form images on substrate. The sealing devices, for example, may be disposed on side surfaces of one or more rollers through an interference fit to prevent ink from leaking out of the ink developer units. The sealing device may incur compression set based on its contact, for example, with a developer roller of an ink developer unit. Consequently, upon replacement of the developer roller, the existing sealing device may not provide a sufficient seal therewith. Additionally, the sealing devices may require stringent manufacturing tolerances and have low durability. Variation of the respective tolerances may result in adverse conditions such as a premature wear condition, a product failure condition, an ink splatter condition, an ink overflow condition, a fused ink condition, and the like.

In examples, a sealing device may be used with an ink developer unit including a plurality of rollers and a plurality of end cap members. The sealing device may include a first replaceable compliant sealing member and a latch member. The first replaceable compliant sealing member may have a plurality of replaceable seal exterior surfaces to form a seal between a first set of rollers of the plurality of rollers and one of the end cap members. The latch member may also have a closed state to maintain a sealing force on the first replaceable compliant sealing member and an open state to remove the sealing force on the first replaceable complaint sealing member. Consequently, upon replacement of the developer roller, the first replaceable compliant member may also be replaced to provide a sufficient seal therewith. Further, the use of a first replaceable compliant sealing member in addition to a second compliant sealing member may enable a wider seal between the first replaceable compliant sealing member and the developer roller to lower the sealing temperature. Accordingly, the sealing device of the present disclosure may require less-stringent manufacturing tolerances, have high durability, and/or include replaceable portions thereof. Thus, the sealing device of the present disclosure may reduce occurrences of a premature wear condition, a product failure condition, an ink splatter condition, an ink overflow condition, a fused ink condition, and the like. Additionally, the sealing device may reduce the need to replace the ink developer unit due to wear of a sealing device therein.

FIG. 1 is a schematic view illustrating an image forming apparatus having an ink developer unit including a sealing device according to an example. Referring to FIG. 1, an image forming system 100 such as an LEP includes an image forming assembly 14 that receives substrate S from an input unit 14*a* and outputs the substrate S to an output unit 14*b*. The image forming assembly 14 includes an ink developer unit 13 and a photoconductive member 18 on which images can be formed. In some examples, the image forming apparatus 100 may include a plurality of ink developer units 13. The photoconductive member 18 may include an outer surface 18*a* to be charged with a charging member 10 such as a charge roller, and the like. The charge of selected portions of the outer surface 18*a* of the photoconductive member 18 that correspond to features of the image can be selectively changed by an imaging member 16 such as a laser writing unit, and the like, to form a latent image thereon. That is, the imaging member 16 may increase or decrease an amount of charge on selected portions of the outer surface 18*a* of the photoconductive member 18 to form a latent image thereon.

Referring to FIG. 1, in some examples, an ink developer unit 13 such as binary ink developers may apply the fluid such as liquid toner to the latent image on the outer surface 18*a* of the photoconductive member 18 to form an image to be transferred to an intermediate transfer member (ITM) 15 that may include a blanket 15*a* thereon. The ink develop unit 13, for example, may include a sealing device 17 to reduce unwanted ink from leaking out of the ink developer unit 13. In some examples, each ink developer unit 13 may include a pair of sealing devices 17. Subsequently, the ITM 15 may transfer the image to the substrate S. During the transfer of the image from the blanket 15*a* of the ITM 15 to the substrate S, the substrate S may be pinched between the ITM 15 and an impression member 19. Once the image has been transferred to the substrate S, the substrate S may be transported to the output unit 14*b*.

Figure 2A:
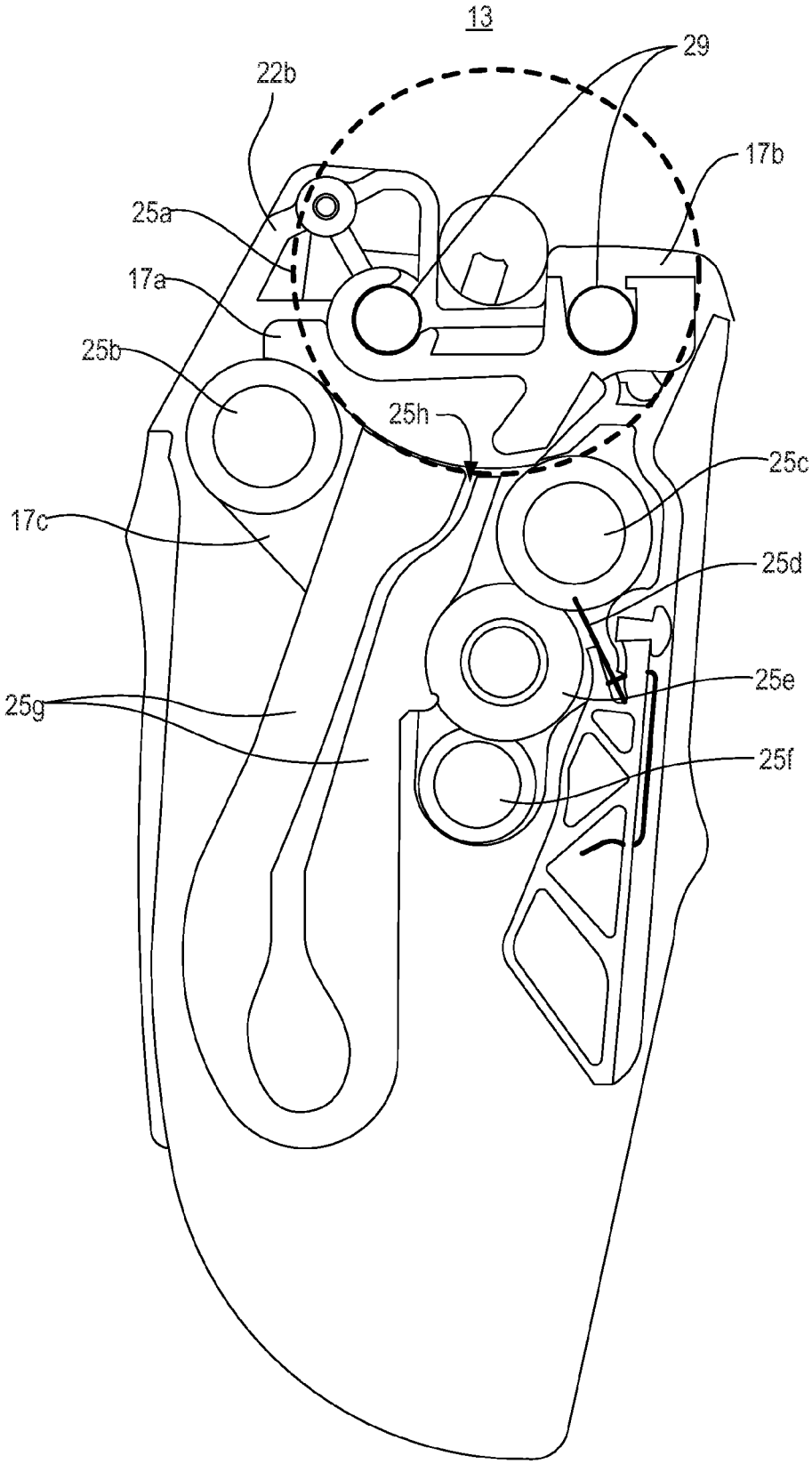
FIG. 2A is a cross-sectional view illustrating the ink developer unit of FIG. 1 according to an example.
Figure 2B:
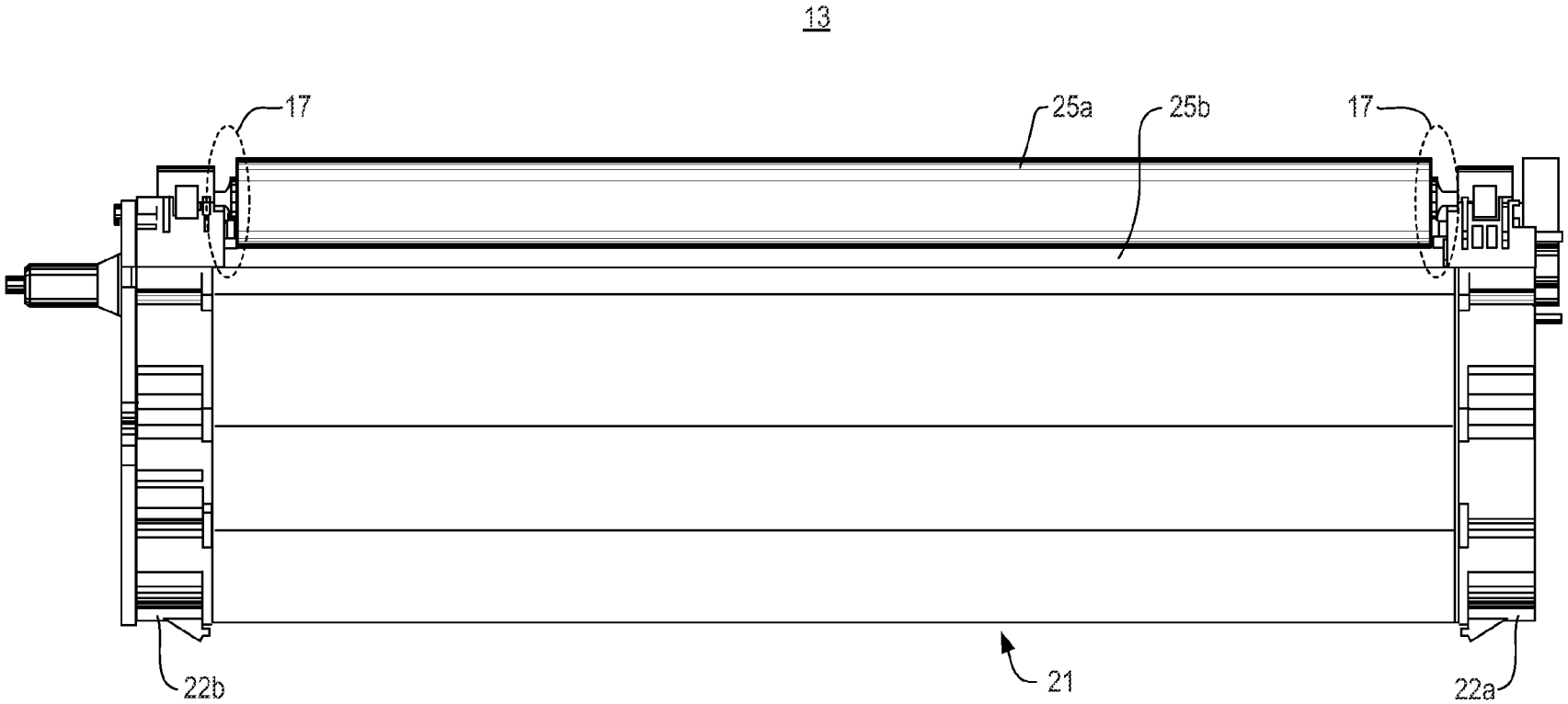
FIG. 2B is a schematic view illustrating the ink developer unit of FIG. 2A according to an example.

FIG. 2A is a cross-sectional view illustrating the ink developer unit of FIG. 1 according to an example. FIG. 2B is a schematic view of the ink developer unit of FIG. 2A according to an example. Referring to FIGS. 2A and 2B, in some examples, an ink developer unit 13 such as a BID may include a housing unit 21 and end cap members 22*a* and 22*b*. The ink developer unit 13 may removably engage with a photoconductive drum 18 (FIG. 1) of an image forming apparatus 100 such as an LEP. The housing unit 21 may include a developer roller 25*a*, a squeegee roller 25*b*, a cleaner roller 25*c*, a wiper blade 25*d*, a sponge roller 25*e*, a squeezer roller 25*f*, a pair of electrodes 25*g*, a channel 25*h*, and at least one sealing device 17. In an example, the pair of electrodes 25*g* may form the channel 25*h* or a portion thereof. The at least one sealing member 17 may include a first replaceable compliant sealing member 17*a*, a latch member 17*h*, and a second compliant sealing member 17*c*. In some examples, the ink developer unit 13 may include a pair of sealing devices 17.

Referring to FIGS. 2A and 2B, in some examples, the ink developer unit 13 may provide a uniform film of ink such as liquid toner to a photoconductive drum 18. The developer roller 25*a* may supply a film of the ink to be selectively transferred to the photoconductive drum 18. For example, the developer roller 25*a* may rotate through a flow of the ink to adhere ink thereto. The developer roller 25*a* may be a replaceable developer roller. That is, the developer roller 25*a* may be replaced within the housing unit 21 of the ink developer unit 13 when needed. The pair of electrodes 25*g* and the developer roller 25*a* may be electrically charged to manipulate, for example, ink particles onto the developer roller 25*a*. The channel 25*h* disposed within the housing unit 21 may provide ink to the developer roller 25*a*. The squeegee roller 25*b* may compact the ink on the developer roller 25*a* to form a uniform layer thereon. The sponge roller 25*e* may contact and clean the wiper 25*d*. The squeezer roller 25*f* may contact and clean the sponge roller 25*e*.

Ink on the developer roller 25*a* may be attracted and transferred to the charged portions of the photoconductive drum 18. The charged portions may correspond to an image to be printed. The image in the form of ink may be subsequently transferred to a substrate S either directly or through an ITM 15 (FIG. 1). The cleaner roller 25*c* may remove access ink remaining on the developer roller 25*a* and not previously transferred to the photoconductive drum 18. In some examples, the wiper blade 25*d* may scrape excess ink from the cleaner roller 25*c*. The end cap members 22*a* and 22*b* may rotatably support at least one roller of the plurality of rollers 25 such as the developer roller 25*a*, and the like. For example, the housing unit 21 may include a pair of end cap members 22*a* and 22*b* to support each end of the developer roller 25*a*. In some examples, the end cap members 22*a* and 22*b* may include support members 29 such as cylindrical members to engage the latch member 17*b*.

Figure 3:
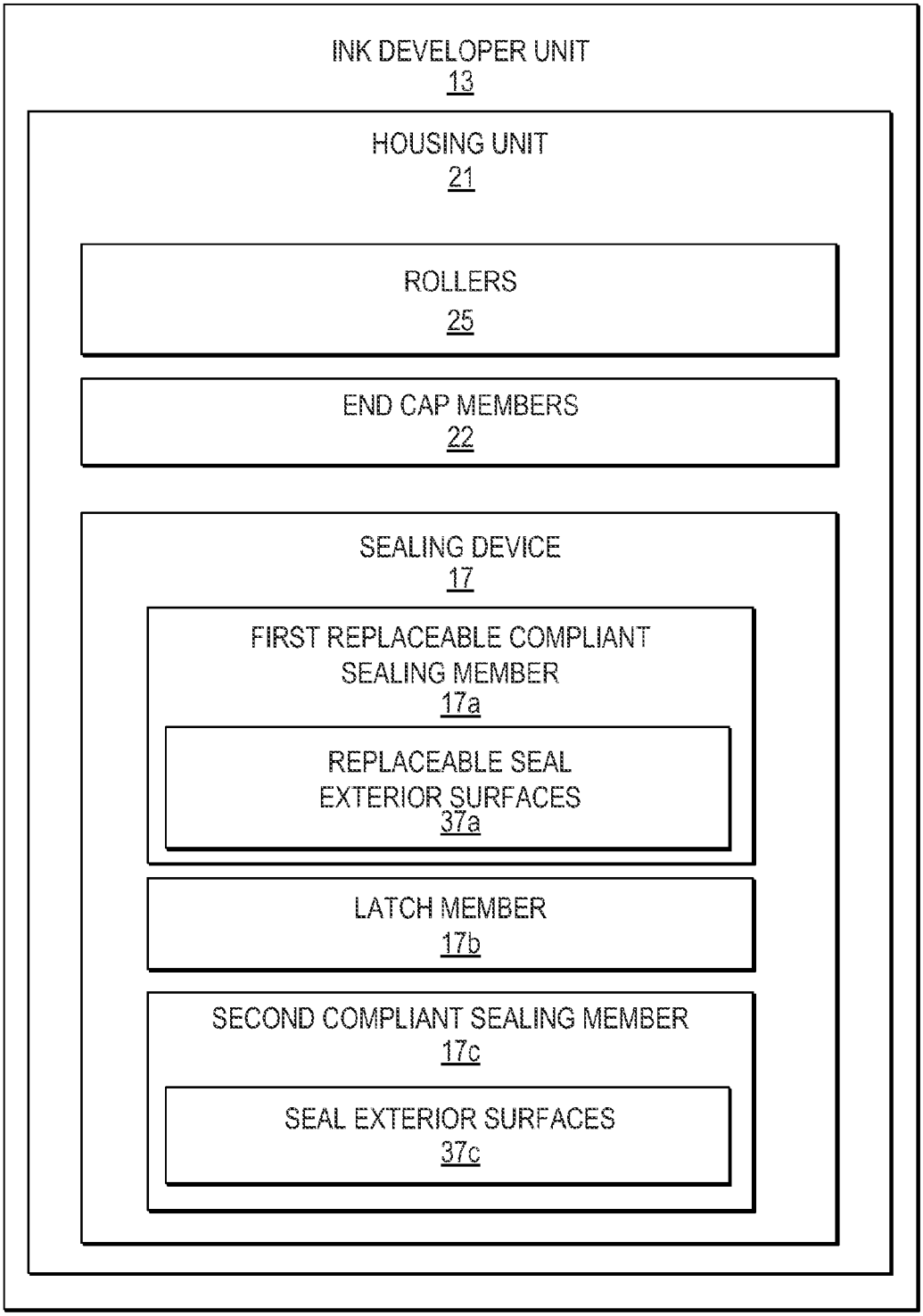
FIG. 3 is a block diagram illustrating the ink developer unit of FIG. 1 according to an example.

FIG. 3 is a block diagram illustrating the ink developer unit of FIG. 1 according to an example. Referring to FIG. 3, in some examples, an ink developer unit 13 includes a housing unit 21, a plurality of rollers 25 rotatably attached to the housing unit 21, a plurality of end cap members 22*a* and 22*b* (collectively 22) of the housing unit 21 to support at least one roller of the plurality of rollers 25*a*, 25*b*, 25*c*, 25*e* and 25*f* (collectively 25), and at least one sealing device 17 disposed within the housing unit 21 in an installed state. The at least one sealing device 17 may include a first replaceable compliant sealing member 17*a*, a latch member 17*b*, and a second compliant sealing member 17*c*. In some examples, the first replaceable compliant sealing member 17*a* and the second compliant sealing member 17*c* may also include closed cell foam.

Referring to FIG. 3, in some examples, the first replaceable compliant sealing member 17*a* may have a plurality of replaceable seal exterior surfaces 37*a* to form a seal between a first set of rollers of the plurality of rollers 25 and one of the end cap members 22*a*. The seal may be formed by the replaceable seal exterior surfaces 37*a* of the first replaceable compliant sealing member 17*a* and may limit an unwanted flow of ink from inside to outside of the ink developer unit 13 such as the housing unit 21. The latch member 17*b* may have a closed state to maintain a sealing force on the first replaceable compliant sealing member 17*a* and an open state to remove the sealing force on the first replaceable complaint sealing member 17*a*. The second compliant sealing member 17*c* may have a plurality of seal exterior surfaces 37*c* to form a seal between a second set of rollers of the plurality of rollers 25 and the one of the end cap members 22*a*. The seal formed by the seal exterior surfaces 37*c* of the second compliant sealing member 17*c* may limit the unwanted flow of ink from the inside to the outside of the ink developer unit 13 such as the housing unit 21. In some examples, the at least one sealing device 17 comprises a pair of sealing devices.

Figure 4:
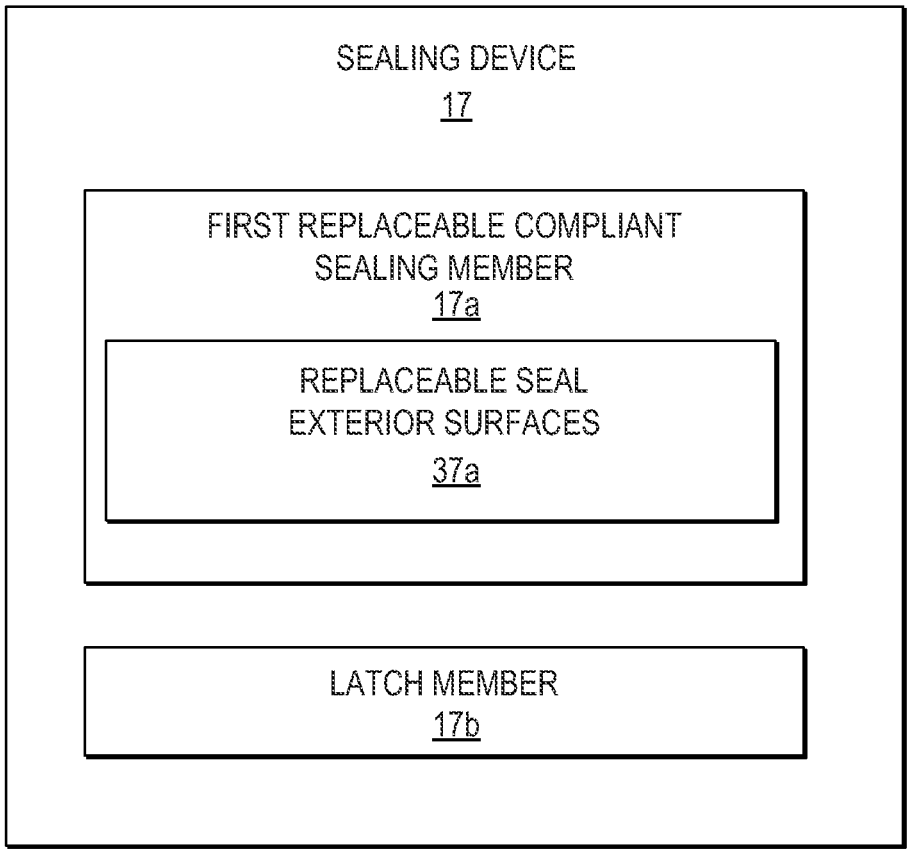
FIG. 4 is a block diagram illustrating a sealing device usable with an ink developer unit including a plurality of rollers and a plurality of end cap members according to an example.

FIG. 4 is a block diagram illustrating a sealing device usable with an ink developer unit including a plurality of rollers and a plurality of end cap members according to an example. Referring to FIGS. 3 and 4, in some examples, a sealing device 17 is usable with an ink developer unit including a plurality of rollers 25 and a plurality of end cap members 22*a* and 22*b* (collectively 22). The sealing device 17 may include a first replaceable compliant sealing member 17*a* and a latch member 17*b*. The first replaceable compliant sealing member 17*a* having a plurality of replaceable seal exterior surfaces 37*a* to form a seal between a first set of rollers of the plurality of rollers 25 and one of the end cap members 22*a*. The latch member 17*b* may have a closed state to maintain a sealing force on the first replaceable compliant sealing member 17*a* and an open state to remove the sealing force on the first replaceable complaint sealing member 17*a*.

Figure 5:
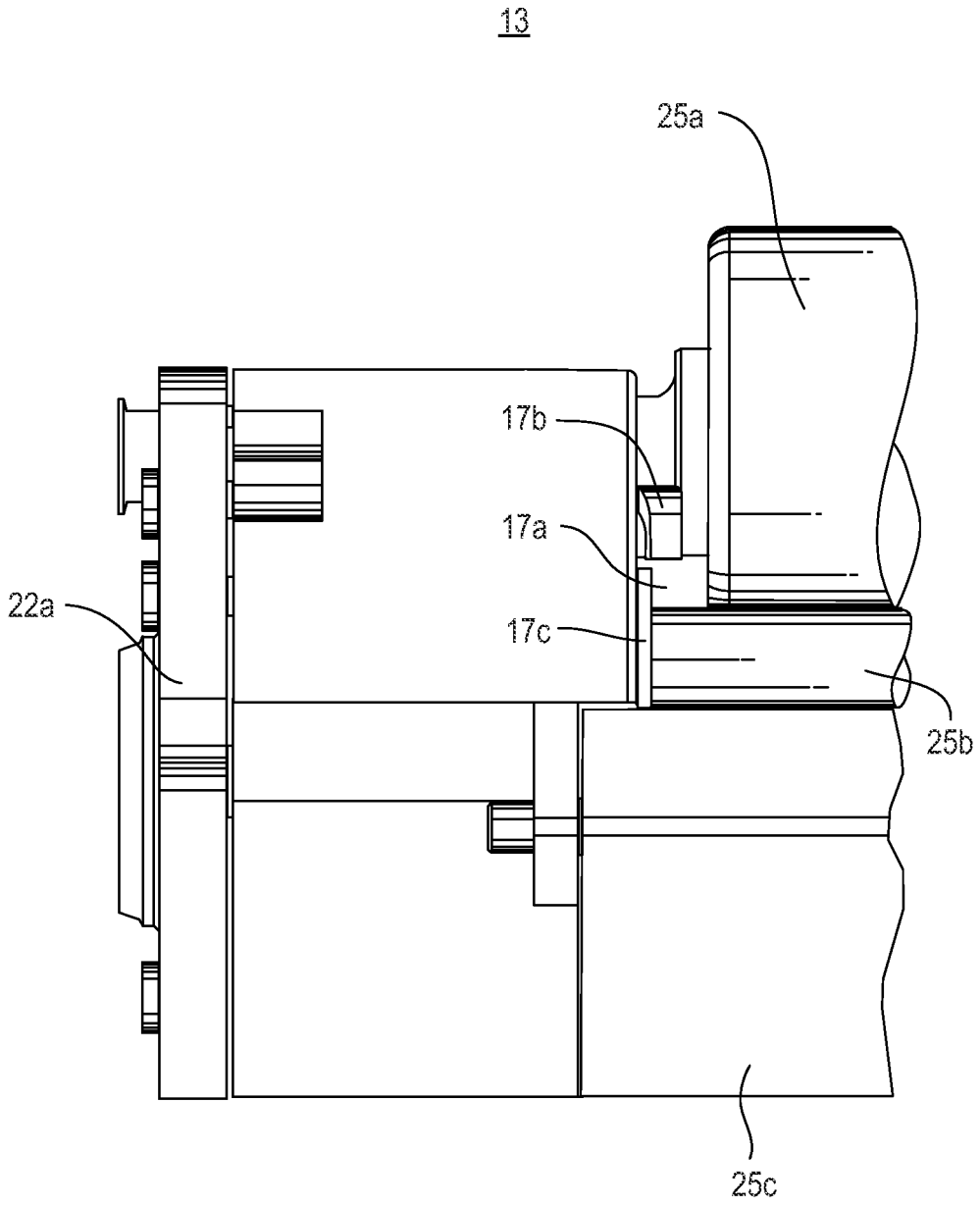
FIG. 5 is a schematic view illustrating a portion of an ink developer unit including the sealing device of FIG. 4 according to an example.

FIG. 5 is a schematic view illustrating a portion of an ink developer unit including the sealing device of FIG. 4 according to an example. Referring to FIG. 5, in some examples, a sealing device 17 may include the first replaceable compliant sealing member 17*a* and the latch member 17*b* as previously disclosed with respect to FIG. 4. As illustrated in FIG. 5, in some examples, the sealing device 17 may also include a second compliant sealing member 17*c* having a plurality of seal exterior surfaces to form a seal between a second set of rollers of the plurality of rollers 25 and the one of the end cap members 22*a*. The first set of rollers may include a developer roller 25*a*, a squeegee roller 25*b*, and a cleaner roller 25*c*. The replaceable seal exterior surfaces of the first replaceable compliant sealing member 17*a* may contact the developer roller 25*a*, the squeegee roller 25*b*, the cleaner roller 25*c*, and the one of the end cap members 22*a*. The developer roller 25*a* may supply a film of ink to be selectively transferred to a photoconductive drum 18. The developer roller 18 may include a replaceable developer roller. The squeegee roller 25*b* may compact the ink on the developer roller 25*a* to form a uniform layer thereon. The cleaner roller 25*c* may remove access ink remaining on the developer roller 25*a* and not previously transferred to the photoconductive drum 18.

In some examples, the second set of rollers may include the squeegee roller 25*b* and the cleaner roller 25*c*. The seal exterior surfaces of the second compliant sealing member 17*c* may contact the squeegee roller 25*b*, the cleaner roller 25*c*, and the one of the end cap members 22*a*. The first replaceable compliant sealing member 17*a* and the second compliant sealing member 17*c* may also include dosed cell foam. In some examples, the ink developer unit 13 may also include an adhesive 83 (FIG. 8) and a channel 25*h*. The adhesive 83 may be in contact with the housing unit 21 such as one of the end cap members 22*a* and a third seal exterior portion 87*c* of the seal exterior surfaces of the second compliant sealing member 17*c*. The adhesive 83 may couple the second complaint sealing member 17*c* to the housing unit 21. The channel 25*h* may be disposed within the housing unit 21 to provide ink to one roller of the plurality of rollers 25 such as the developer roller 25*a*.

Figure 6:
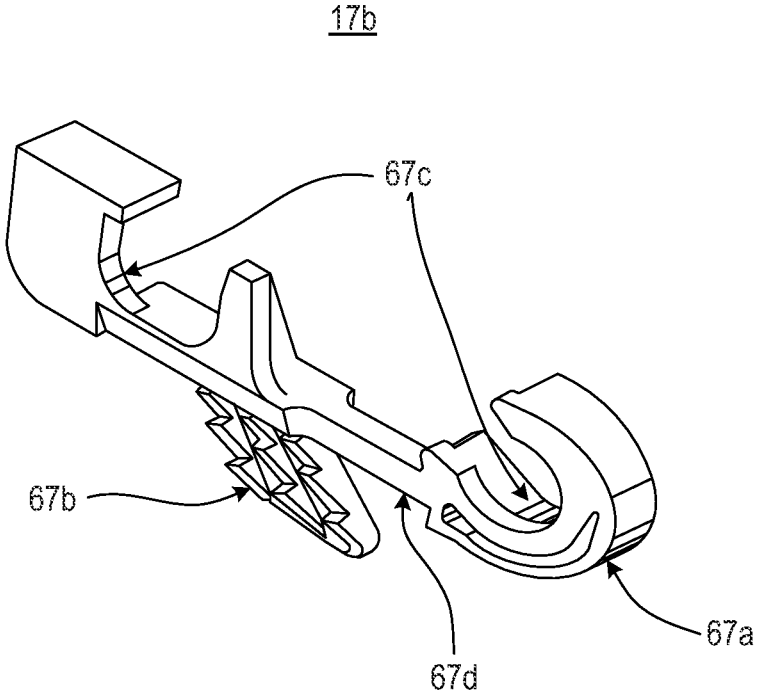
FIG. 6 is a schematic view illustrating a latch member of the sealing device of FIG. 1 according to an example.

FIG. 6 is a schematic view illustrating a latch member of the sealing device of FIG. 1 according to an example. Referring to FIGS. 5 and 6, in some examples, a latch member 17*b* may include a cam portion 67*a*, a friction portion 67*b*, support engagement portions 67*c*, and sealing member contact portion 67*d*. The cam portion 67*a* may maintain a sealing force on the first replaceable compliant sealing member 17*a* in the closed state and remove the sealing force on the first replaceable complaint sealing member 17*a* in the open state. For example, a cam surface may be disposed at a pivot location of the latch member 17*b*. As the latch member 17*b* is placed in the closed state, the cam surface may compress the first replaceable compliant sealing member 17*a* against the squeegee roller 25*b* to form a seal. When the latch member 17*b* is moved to the open state, the cam surface may lose contact with the first replaceable compliant sealing member 17*a* to allow easy removal and installation by reducing and/or eliminating compression there between.

Referring to FIG. 6, in some examples, the friction portion 67*b* including barbed teeth to engage a first replaceable seal exterior portion 77*a* of the replaceable seal exterior surfaces of the first replaceable compliant sealing member 17*a* in the closed state. In some examples, the cam portion 67*a* and friction portion 67*b* may constrain the first replaceable compliant sealing member 17*a* and apply a sealing force, for example, toward a squeegee nip when the latch member 17*b* is in the closed portion. In the open state, a sealing force is retracted to allow easy replacement of the first replaceable compliant sealing member 17*a*. The support engagement portions 67*c* may engage support members 29 (FIG. 2A), for example, extending from the housing unit 21 and/or end cap members 22*a* and 22*b*. The sealing member contact portion 67*d* may contact the fourth replaceable seal exterior portion 77*d* of the first replaceable compliant sealing member 17*a* in the closed state.

Figure 7:
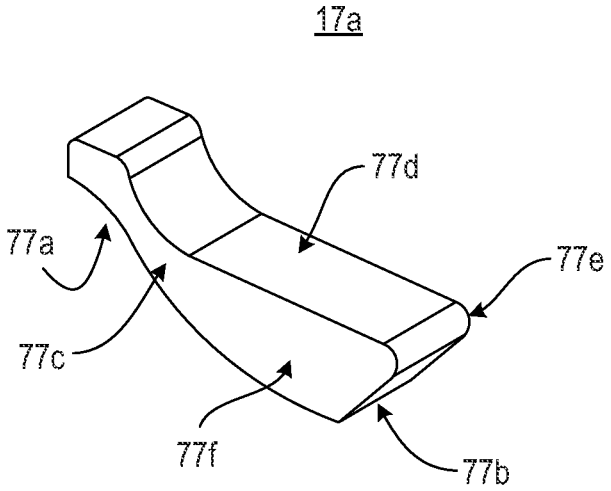
FIG. 7 is a schematic view illustrating a first replaceable compliant sealing member of the sealing device of FIG. 4 according to an example.

FIG. 7 is a schematic view illustrating a first replaceable compliant sealing member of the sealing device of FIG. 4 according to an example. Referring to FIGS. 5 and 7, in some examples, a first replaceable compliant sealing member 17*a* may include a plurality of replaceable seal exterior surfaces. For example, the replaceable seal exterior surfaces may include a first replaceable seal exterior portion 77*a*, a second replaceable seal exterior portion 77*b*, a third replaceable seal exterior portion 77*c*, a fourth replaceable seal exterior portion 77*d*, and a fifth replaceable seal exterior portion 77*e*. The first replaceable seal exterior portion 77*a* may contact and form a seal with a circumference surface of the squeegee roller 25*b*. The second replaceable seal exterior portion 77*b* may tangentially contact and form a seal with a circumference surface of the cleaner roller 25*c*.

Referring to FIG. 7, in some examples, the third replaceable seal exterior portion 77*c* may contact and form a seal with a face surface of the developer roller 25*a*. The fourth replaceable seal exterior portion 77*d* may receive and contact the latch member 17*b*. The fifth replaceable seal exterior portion 77*e* may contact one of the end cap members 22*a*. The sixth replaceable seal exterior portion 77*f* receive and contact the friction portion 67*b* of the latch member 17*b*. In some examples, rotation from the developer roller 25*a* and cleaner roller 25*c* may reduce ink accumulation on a respective seal.

Figure 8:
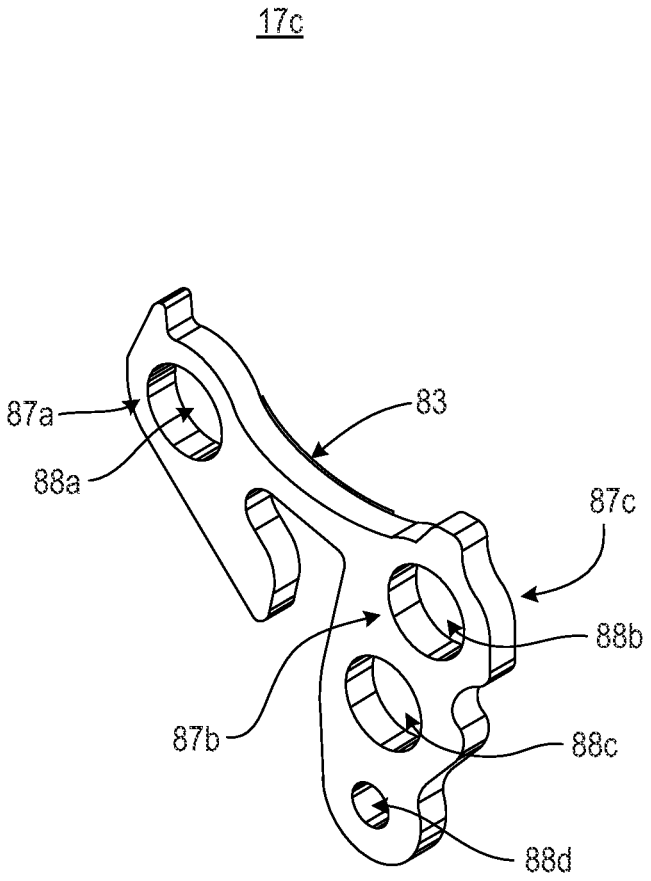
FIG. 8 is a schematic view illustrating a second compliant sealing member of the sealing device of FIG. 4 according to an example.

FIG. 8 is a schematic view illustrating a second compliant sealing member of the sealing device of FIG. 4 according to an example. Referring to FIGS. 5 and 8, in some examples, a second compliant sealing member 17*c* may include a plurality of openings 88*a*, 88*b*, 88*c*, and 88*d* and a plurality of seal exterior surfaces. A first opening 88*a* may provide clearance for a squeegee roller 25*b*, for example, to access dynamic seals and bearings, a second opening 88*b* may provide clearance for a cleaner roller 25*c* to access dynamic seals and bearings, a third opening 88*c* may provide clearance for a sponge roller 25*e* to access dynamic seals and bearings, and a fourth opening 88*d* may provide clearance for a squeezer roller 25*f* to access dynamic seals and bearings.

In some examples, in operation, seal exterior surfaces of the second compliant sealing member 17*c* may form a seal between the squeegee roller 25*b* and the cleaner roller 25*c* and the one of the end cap members 22*a*. For example, a face surface of the squeegee roller 25*b* may compress a first seal exterior portion 87*a* of the seal exterior surfaces and a face surface of the cleaner roller 25*c* may compress a second seal exterior portion 87*b* of the seal exterior surfaces of the second compliant sealing member 17*c*. Additionally, the one end cap member 22*a* may contact and form a seal with a third seal exterior portion 87*c* of the seal exterior surfaces of the second compliant sealing member 170. In some examples, the second compliant sealing member 17*c* may be compressed between the face surface of the squeegee roller 25*b*, the face surface of the cleaner roller 25*c* and one of the end cap members 22*a* to allow the respective rollers to float and maintain nips between respective rollers.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A sealing device usable with an ink developer unit including a plurality of rollers and a plurality of end cap members, the sealing device comprising:

a first replaceable compliant sealing member having a plurality of replaceable seal exterior surfaces to form a seal between a first set of rollers of the plurality of rollers and one of the end cap members; and a latch member having a closed state to maintain a sealing force on the first replaceable compliant sealing member and an open state to remove the sealing force on the first replaceable compliant sealing member.

2. The sealing device according to claim 1, further comprising:

a second compliant sealing member having a plurality of seal exterior surfaces to form a seal between a second set of rollers of the plurality of rollers and the one of the end cap members.

3. The sealing device according to claim 2, wherein the first et of rollers includes:

a developer roller configured to supply a film of ink to be selectively transferred to a photoconductive drum;

a squeegee toiler configured to compact the ink on the developer roller to form a uniform layer thereon; and a cleaner roller configured to remove access ink remaining on the developer roller and not previously transferred to the photoconductive drum; and wherein the second set of rollers includes the squeegee roller and the cleaner roller.

4. The sealing device according to claim 3, wherein the replaceable seal exterior surfaces of the first replaceable compliant sealing member are configured to contact the developer roller, the squeegee roller, the cleaner roller, and the one of the end cap members.

5. The sealing device according to claim 2, wherein the second compliant sealing member further comprises closed cell foam.

6. The sealing device according to claim 1, wherein the first replaceable compliant sealing member further comprises dosed cell foam.

7. The sealing device according to claim 1, wherein the latch member further comprises:

a cam portion to maintain a sealing force on the first replaceable compliant sealing member in the dosed state and to remove the sealing force on the first replaceable compliant sealing member in the open state.

8. The sealing device according to claim 7, wherein the latch member further comprises:

a friction portion including barbed teeth to engage a portion of the plurality of the replaceable seal exterior surfaces of the first replaceable compliant sealing member in the closed state.

9. An ink developer unit, comprising:

a housing unit;

a plurality of rollers rotatably attached to the housing unit;

a plurality of end cap members of the housing unit to support at east one roller of the plurality of rollers; and at least one sealing device disposed within the housing unit in an installed state, the at least one sealing device including:

a first replaceable compliant sealing member having a plurality of replaceable seal exterior surfaces to form a seal between a first set of rollers of the plurality of rollers and one of the end cap members;

a latch member having a closed state to maintain a sealing force on the first replaceable compliant sealing member and an open state to remove the sealing force on the first replaceable compliant sealing member; and a second compliant sealing member having a plurality of seal exterior surfaces to form a seal between a second set of rollers of the plurality of rollers and the one of the end cap members.

10. The ink developer unit according to claim 9, wherein the first replaceable compliant sealing member and the second compliant sealing member further comprise closed cell foam.

11. The ink developer unit according to claim 9, further comprising an adhesive in contact with the housing unit and a portion of the seal exterior surfaces of the second compliant sealing member, the adhesive to couple the second complaint sealing member to the housing unit.

12. The ink developer unit according to claim 9, wherein the first set of rollers comprises:

a developer roller configured to supply a film of ink to be selectively transferred to a photoconductive drum;

a squeegee roller configured to compact the ink on the developer roller to form a uniform layer thereon; and a cleaner roller configured to remove access ink remaining on the developer roller and not previously transferred to the photoconductive drum.

13. The ink developer unit according to claim 12, wherein the developer roller further comprises:

a replaceable developer roller.

14. The ink developer unit according to claim 12, wherein the second set of rollers comprises the squeegee roller and the cleaner roller.

15. The ink developer unit according to claim 9, further comprising:

a channel disposed within the housing unit configured to provide ink to one roller of the plurality of rollers.

16. The ink developer unit according to claim 15, wherein the seal formed by the replaceable seal exterior surfaces of the first replaceable compliant sealing member is configured to limit an unwanted flow of ink from inside to outside of the housing unit and wherein the seal formed by the seal exterior surfaces of the second compliant sealing member is configured to limit the unwanted flow of ink from the inside to the outside of the housing unit.

17. The ink developer unit according to claim 9, wherein the at least one sealing device comprises a pair of sealing devices.

18. An ink developer unit, comprising:

a housing unit;

a plurality of rollers rotatably attached to the housing unit;

a plurality of end cap members of the housing unit to support east one of the plurality of rollers;

a channel disposed within the housing unit configured to provide ink to one of the rollers; and a pair of sealing devices disposed within the housing unit in an installed state, each one of the pair of sealing devices including:

a first replaceable compliant sealing member having a plurality of replaceable seal exterior surfaces to form a seal between a first set of rollers of the plurality of rollers and one of the end cap members;

a latch member including a cam portion, the latch member to maintain a sealing force on the first replaceable compliant sealing member in the closed state and to remove the sealing force on the first replaceable compliant sealing member in the open state; and a second compliant sealing member having a plurality of seal exterior surfaces to form a seal between a second set of rollers of the plurality of rollers and the one of the end cap members; and wherein the first replaceable compliant sealing member and the second compliant sealing member include closed cell foam.

* * * * *

UNITED STATES PATENT AND TRADEMARK OFFICE

CERTIFICATE OF CORRECTION

PATENT NO. : 8,855,527 B2
APPLICATION NO. : 13/560481
DATED : October 7, 2014
INVENTOR(S) : James Pingel et al.

It is certified that error appears in the above-identified patent and that said Letters Patent is hereby corrected as shown below:

In the claims

In column 7, line 21, in Claim 3, delete "et" and insert -- set --, therefor.

In column 7, line 24, in Claim 3, delete "toiler" and insert -- roller --, therefor.

In column 7, line 41, in Claim 6, delete "dosed" and insert -- closed --, therefor.

In column 7, line 45, in Claim 7, delete "dosed" and insert -- closed --, therefor.

In column 7, line 58, in Claim 9, delete "east" and insert -- least --, therefor.

In column 8, lines 17-18, in Claim 13, delete "complaint" and insert -- compliant --, therefor.

In column 8, line 53, in Claim 20, delete "east" and insert -- at least --, therefor.

Signed and Sealed this
Ninth Day of August, 2016

Michelle K. Lee

Michelle K. Lee
*Director of the United States Patent and Trademark Office*